US011332950B2

(12) United States Patent
Schmidt

(10) Patent No.: US 11,332,950 B2
(45) Date of Patent: May 17, 2022

(54) POOL SKIMMER DEVICES, SYSTEMS, AND METHODS

(71) Applicant: Robert Douglas Schmidt, San Diego, CA (US)

(72) Inventor: Robert Douglas Schmidt, San Diego, CA (US)

( * ) Notice: Subject to any disclaimer, the term of this patent is extended or adjusted under 35 U.S.C. 154(b) by 0 days.

(21) Appl. No.: 16/983,508

(22) Filed: Aug. 3, 2020

(65) Prior Publication Data

US 2021/0062527 A1 Mar. 4, 2021

Related U.S. Application Data

(60) Provisional application No. 62/893,730, filed on Aug. 29, 2019.

(51) Int. Cl.
*E04H 4/12* (2006.01)

(52) U.S. Cl.
CPC ..... *E04H 4/1263* (2013.01); *E04H 4/1272* (2013.01)

(58) Field of Classification Search
CPC ..... E04H 4/1263; E04H 4/1272
USPC .. 210/167.12, 167.1, 238, 776, 416.1, 416.2
See application file for complete search history.

(56) References Cited

U.S. PATENT DOCUMENTS

| | | | | |
|---|---|---|---|---|
| 3,567,020 | A * | 3/1971 | Whitaker | E04H 4/1272 210/94 |
| 3,616,916 | A | 11/1971 | Greene | |
| 4,212,740 | A | 7/1980 | Greene | |
| 5,133,854 | A * | 7/1992 | Horvath | B01D 29/27 15/1.7 |
| 5,830,350 | A | 11/1998 | Voss | |
| 6,224,753 | B1 * | 5/2001 | Marbach | E04H 4/1263 137/101.27 |
| 6,709,582 | B2 * | 3/2004 | Danner | A01K 63/045 210/170.02 |
| 7,727,387 | B2 | 6/2010 | Goggin | |
| 8,721,881 | B1 | 5/2014 | Smith | |
| 8,728,307 | B2 | 5/2014 | Lacovacci | |
| 9,581,478 | B1 | 2/2017 | Smith | |
| 9,879,439 | B2 | 1/2018 | Norberto, III | |
| 9,945,139 | B2 | 4/2018 | Noberto, III et al. | |
| 10,260,247 | B2 | 4/2019 | Noberto, III et al. | |
| 2014/0202941 | A1 | 7/2014 | Iacovacci | |
| 2014/0209546 | A1 | 7/2014 | Smith | |
| 2015/0247332 | A1 * | 9/2015 | Norberto, III | E04H 4/1209 210/167.2 |

* cited by examiner

*Primary Examiner* — Fred Prince
(74) *Attorney, Agent, or Firm* — Knobbe Martens Olson & Bear LLP

(57) ABSTRACT

A powered or non-powered pool skimmer device can include a funnel assembly comprising a funnel having a wide opening and a narrow opening, and a funnel profile extending between the wide opening and the narrow opening, a funnel plate to allow the funnel to freely float or be manually adjusted to position the funnel just beneath the water surface, a filter assembly positioned below the funnel assembly, and a main body with no bottom, so water can flow freely into the swimming pool's main filter system, that fits into an existing skimmer in both height and diameter extending along an axis, which can be locked into the skimmer via a skimmer adapter ring, wherein the funnel assembly, the filter assembly, and the pump assembly are positioned within the main body and arranged along the axis.

16 Claims, 10 Drawing Sheets

POOL SKIMMER DEVICES, SYSTEMS, AND METHODS

RELATED APPLICATIONS

This application claims the benefit of priority to U.S. Provisional Patent Application No. 62/893,730, filed Aug. 29, 2019, the disclosure of which is incorporated by reference herein in its entirety. This application is also related to U.S. application Ser. Nos. 16/516,021, 16/516,030, and 16/516,013, each filed on Jul. 18, 2019, each of which are also incorporated herein by reference in their entireties.

FIELD OF THE DISCLOSURE

This application relates to pool skimmer devices, systems, and methods.

BACKGROUND

Swimming pools are enjoyed by many for leisure and exercise in both private and public settings. To provide healthy conditions and maximum enjoyment, it is important to ensure that water within a swimming pool remains clean, clear, and free from debris. For this reason, swimming pools generally include circulation and filtration systems that are designed to clean the water.

Many swimming pools accumulate unwanted debris, such as leaves, pollen, seeds, insects, etc., on the surface of the water. Commonly, existing circulation and filtration systems may be ineffective at removing this debris from the water's surface. Accordingly, pool owners frequently and undesirably are required to manually capture and remove debris from the water's surface using a pool skimmer net.

SUMMARY

In a first aspect, a powered pool skimmer device is disclosed. The device includes a bucket that houses a water pump that is placed under a filter basket that is fed swimming pool surface water through a funnel that floats just below the surface water of the skimmer. The pump pulls water through the funnel, through the filter basket, and exhausts the filtered water back into the pool through an exhaust port incorporated into the bucket. This exhaust water is ported back into the swimming pool through the skimmer opening.

The device can include one or more of the following features in any combination: (a) a bucket that fits into an existing skimmer that will house the powered skimmer components; (b) a water pump that is capable of pumping water through the funnel, filter, and exhaust port back into the swimming pool; (c) a filter basket that has various size mesh openings to catch debris in the water flowing through the powered skimmer; (d) a mounting plate that is positioned over the filter basket that supports the filter basket, and also supports the funnel that water will flow through into the filter apparatus; (e) an exhaust port for the exhaust of filtered water back into the swimming pool; (f) a self-adjusting floating funnel that positions itself just below the water surface; (g) a manually adjustable funnel that can be manually positioned just beneath the surface water in the skimmer; (h) a water level sensing switch that will shut off the pump when water flow into the skimmer ceases; (h) the profile of the funnel is defined by an equation $-1/x$, where x is the distance from the central axis of the curve; (i) the diameter of the funnel openings are implicitly defined by $-1/x$ plus some offset perpendicular to the central axis of the funnel (for example: $x(t)=t+0.5$, $y(t)=-1/t$); and/or (j) the pump is DC and of varying voltages that are adjusted to control the water flow through the filter, and thus the position of the funnel.

In another aspect, a pool skimmer device is disclosed. The device includes an adapter that will allow it to adapt to an existing skimmer opening or basket, a filter basket that is fed swimming pool surface water through a funnel that floats just below the surface water of the skimmer. This device is powered by the water that flows into the skimmer and into the existing filter system for the swimming pool.

The device can include one or more of the following features in any combination: (a) an adapter ring that will allow the skimmer device to adhere to the existing skimmer structure; (b) an adapter ring that will allow the skimmer device to adhere to the existing skimmer filter basket; (c) a filter basket that has various size mesh openings to catch debris in the water flowing through the skimmer device; (d) a mounting plate that adheres to the adapter ring or is part of the adapter ring that is positioned over the filter basket that supports the filter basket, and also supports the funnel that water will flow through into the filter apparatus; (e) a self-adjusting floating funnel that positions itself just below the water surface; (f) a manually adjustable funnel that can be manually positioned just beneath the surface water in the skimmer; (g) the profile of the funnel is defined by an equation $-1/x$, where x is the distance from the central axis of the curve; and/or (i) the diameter of the funnel openings are implicitly defined by $-1/x$ plus some offset perpendicular to the central axis of the funnel (for example: $x(t)=t+0.5$, $y(t)=-1/t$).

DETAILED DESCRIPTION

This application relates to devices, systems, and methods that are configured to clean a pool, such as a swimming pool. The devices, systems, and methods may be configured, in particular, to clean debris, such as pollen, insects, seeds, leaves, etc., from the surface of the water in a pool. As will be described in greater detail below, the devices, systems, and methods may be configured to use the surface tension of the water to pull in debris from the surface of the water.

Figure 2:
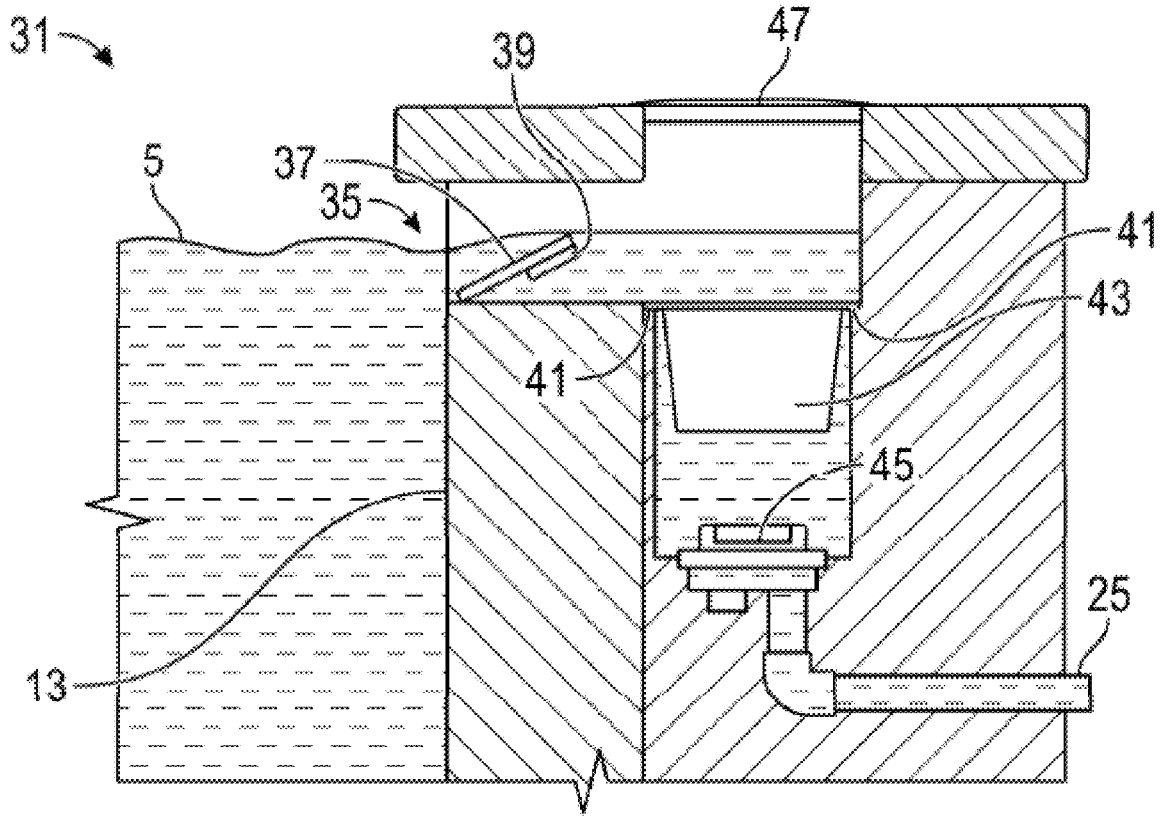
FIG. 2 (Prior Art)
FIG. 2 is a cross-sectional view of an embodiment of a pool skimmer.

Generally, swimming pools include pool skimmers in an effort to clear the surface of the water from debris. An example of such a skimmer is shown in FIG. 2 described below. These skimmers, however, do not work effectively, often failing to sufficiently clean the surface of the pool of debris. For example, with such a skimmer, even after the debris has entered the skimmer, it may not be sucked into the filter. This can be particularly true for smaller debris (such as pollen, small insects, seeds, etc.) as these types of debris float and do not saturate. Further, debris trapped in the skimmer may float out of the skimmer and back into the pool after the filter is powered off. Again, this can be particularly true for small debris which can often float over or around the pool skimmer's weir door.

The following discussion presents detailed descriptions of the several embodiments of the pool skimmer devices, systems, and methods shown in the figures. These embodiments are not intended to be limiting, and modifications, variations, combinations, etc., are possible and within the scope of this disclosure. As will be discussed in more detail below, these pool skimmer devices, systems, and methods can be used to efficiently and effectively clean the surface of a pool.

Figure 1:
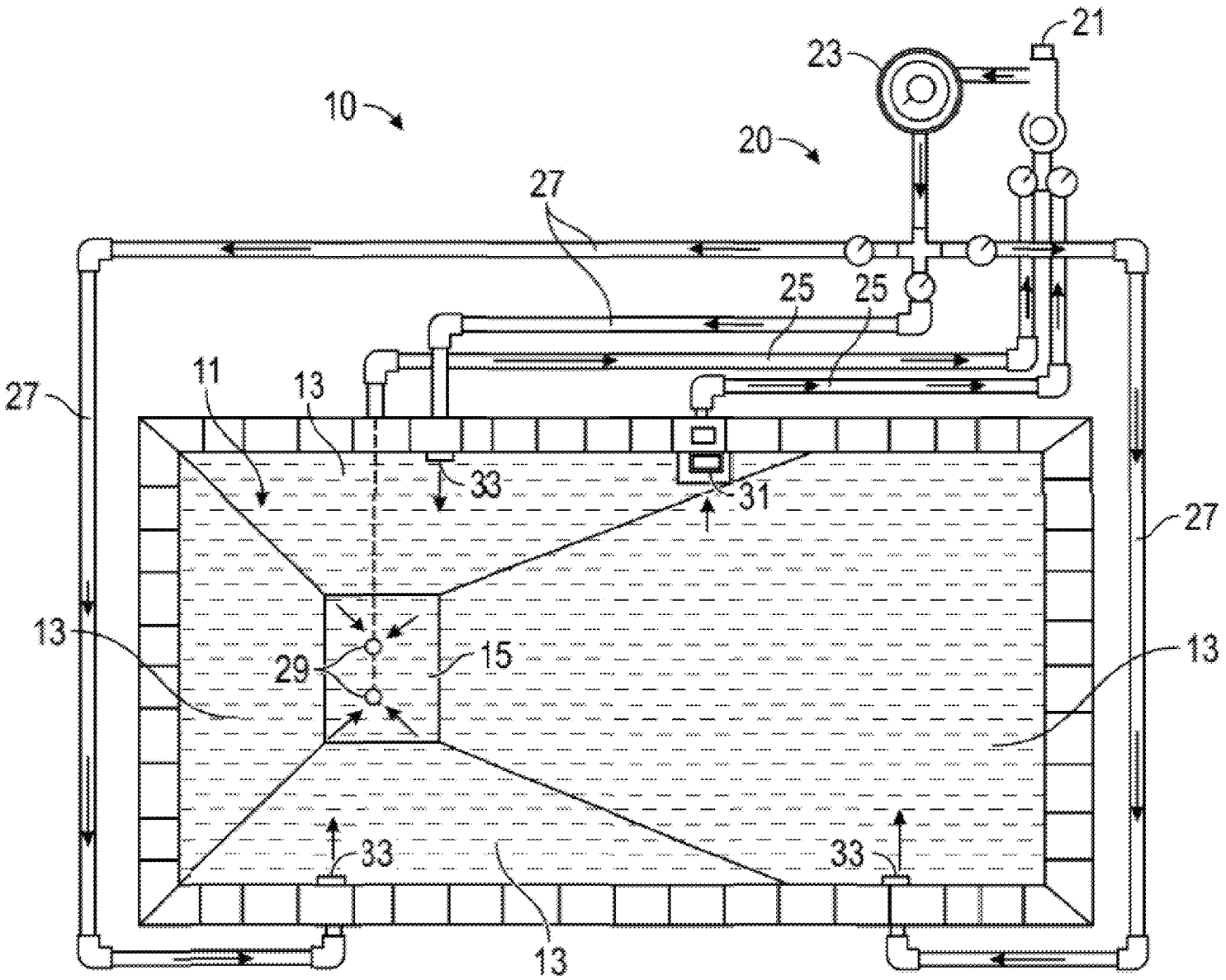
FIG. 1 (Prior Art)
FIG. 1 is a schematic illustration of an embodiment of a pool system.

FIG. 1 is a schematic illustration of an embodiment of a pool system 10. As illustrated, the pool system 10 includes a pool 11 and a circulation and filtration system 20. The pool system 10 may be representative of an outdoor pool system, an indoor pool system, an inground pool system, an above ground pool system, or any other type of pool system. The pool 11 of the pool system 10 can include freshwater or saltwater. The pool 11 of the pool system 10 includes sidewalls 13 and the bottom surface 15 that contain the water of the pool 11. Although illustrated with a generally rectangular shape, the pool 11 can be formed with any suitable shape as desired.

The pool system 10 includes a circulation and filtration system 20 configured to circulate and clean the water of the pool 11. Various types of circulation and filtration systems 20 can be used. As illustrated, the circulation and filtration system 20 includes a water pump 21 that circulates water from the pool 11 through various suction lines 25 and return lines 27. The water pump 21 also circulates the pool water through a filter 23.

Example flow of water through the circulation and filtration system 20 of the pool system 10 will now be described with reference to FIG. 1. As illustrated, the pool system 10 includes two main drains 29 positioned in the bottom surface 15 of the pool 11. The water pump 21 pulls water from the pool 11 through the main drains 29 and corresponding suction lines 25.

The pool system 10 also includes a pool skimmer 31. The pool skimmer 31 can be positioned in a sidewall 13 of the pool 11. An example pool skimmer 31 is shown in greater detail in the cross-sectional side view of FIG. 2, which is described in more detail below. As shown in FIGS. 1 and 2, the pool skimmer 31 is positioned in the sidewall 13 of the pool 11 near the water line of the water in the pool 11. The water pump 21 also pulls water from the pool 11 through the pool skimmer 31 and the corresponding suction line 25. The water pump 21 then pumps the water in the suction lines 25 through the filter 23. After passing through the filter 23, the water pump 21 moves the water through return lines 27. In the illustrated embodiment the pool system 10 includes three returns 33 through which the water is returned to the pool 11.

The pool skimmer 31 attempts to clean the surface of the water of the pool 11 as the pump 23 pulls water through the pool skimmer 31. The conventional process by which the pool skimmer 31 will be described with reference to FIG. 2.

FIG. 2 is a cross-sectional view of an embodiment of the pool skimmer 31 of the pool system 10 of FIG. 1. As shown, the pool skimmer 31 includes an aperture 35 formed in the sidewall 13 of pool 11. The aperture 35 is generally provided at the surface 5 of the water in the pool at 11. The aperture 5 may be generally rectangular, although other shapes are possible. The aperture 35 may be formed in the coping of the sidewall 13 of the pool 11. The aperture 35 allows water from the surface 5 of the pool 11 (for example, the top 0 to 5 inches of water) to enter into the pool skimmer 31 through the aperture 35.

The pool skimmer 31 can include a weir door 37 configured to close the aperture 35. The weir door 37 can comprise a hinged door and a float 39. The float 39 is configured to raise the weir door 37 to close the aperture 35 (for example, such that the top of the weir door 37 is positioned at the surface 5 of the water). When the pump 21 (FIG. 1) is active, the pull of water through the pump 21 may cause water from the pool 11 to flow over the weir door 37 and into the pool skimmer 31.

Figure 3:
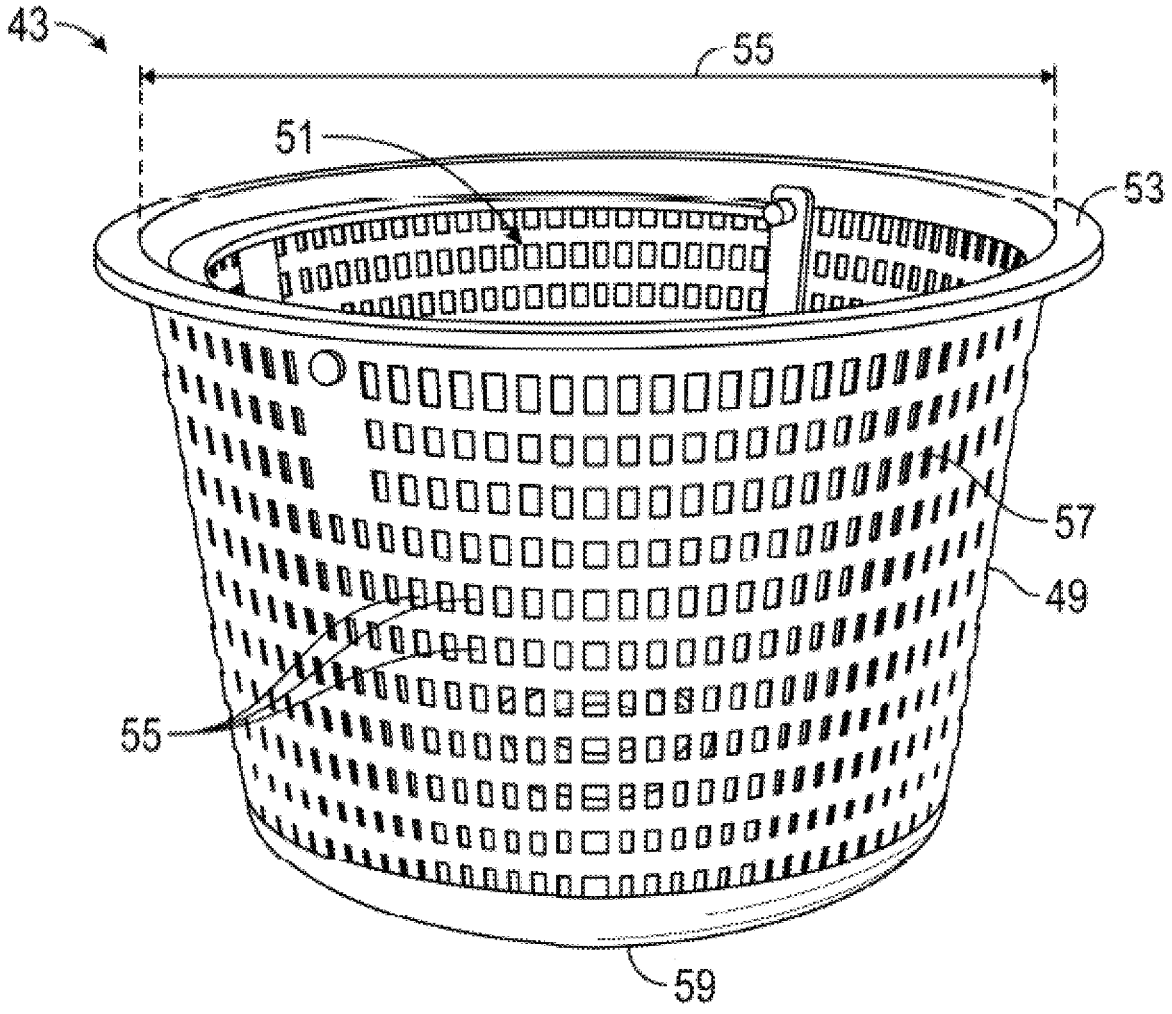
FIG. 3 (Prior Art)
FIG. 3 is a perspective view of an embodiment of a skimmer basket.

Within the pool skimmer 31, the pool skimmer includes a skimmer basket 43. The skimmer basket 43 can be supported by a ledge 41 or other supporting structure within the pool skimmer 31. An example skimmer basket 43 is shown in FIG. 3, which is described in more detail below. The skimmer basket 43 is generally configured to serve as a filter or strainer (for example, including perforated openings or mesh) configured to prevent debris (e.g., debris larger than the perforated openings) from being sucked through pool skimmer 31 and into the water pump 21.

Below the skimmer basket 43, the pool skimmer 31 can, in some embodiments, include a float valve 45. The float valve 45 can be configured as a safety device for the water pump 21. If the water gets low in the pool 11, a float inside the float valve 45 can fall down to shut off the pool skimmer 31 such that the water pump 21 only pulls water from the main drains 29 of the pool 11. This can prevent damage to the water pump 21 caused by running the pump dry. In some embodiments, a pool system 10 can have the line to the bottom filter capped. However, there are many installations where this opening is not capped, and a pipe extends to the bottom filter opening. In these configurations, the float valve 45 is available.

FIG. 2 further illustrates a portion of the suction line 25 that connects the pool skimmer 31 to the water pump 21. In use, the water pump 21 pulls water over the weir door 37 and into the pool skimmer 31. The water is then pulled down through the skimmer basket 43, which strains larger debris from passing therethrough. The water is then pulled through the float valve 45 (if installed) and suction line 25 to the water pump 21. Large debris may be caught within the skimmer basket 43. Some small debris may also become saturated and enter the skimmer basket 43. When the water pump 21 is disengaged, however, much of the debris in the skimmer basket 43 is free to float back up to the surface 5 of the water and join small debris that is already floating above the skimmer basket 43. In some instances, the floating debris is able to float over or around the weir door 37, through the aperture 35, and back into the pool 11. Thus, a pool skimmer 31 as shown in FIG. 2 can be inefficient at cleaning the surface 5 of the water, leading many pool owners to run their filtration and circulation systems at high power and/or for an extended duration in an effort to get small floating debris to actually submerge and enter the suction line 25 to the filter 23.

Another problem with pool skimmers 31 such as shown in FIG. 2 is that they are often only able to trap and remove debris from the surface 5 of the pool water when the debris moves close to the aperture 35 of the pool skimmer 31 so as to be sucked into the skimmer basket 43. This can leave a large portion the pool surface uncleaned. The pool skimmer 31 has no mechanism for pulling the surface 5 of the water into the pool skimmer.

FIG. 3 is a perspective view of an embodiment of the skimmer basket 43 of the pool skimmer 31 of FIG. 2. In the illustrated embodiment, the skimmer basket 43 includes a main body 49. As shown, the main body 49 of the skimmer basket 43 comprises a tapered cylindrical or frustoconical shape. Other shapes for the main body 49 of the skimmer basket 43 are also possible, such as fully cylindrical or even rectangular. In FIG. 3, the main body 49 of the skimmer basket 43 comprises side walls 49 and bottom wall 59. The skimmer basket 43 also comprises an upper opening 51 surrounded by a rim 53.

The upper opening 51 provides an entrance into the skimmer basket 43. The upper opening 51 can have a diameter 55 as shown. Various pool supply manufacturers provide different types of skimmer baskets 43 for different types of pool skimmers 31. Accordingly, the diameter 55 of the upper opening 51 may be different depending on the specific embodiment of the skimmer basket 53. Although the upper opening 51 is described as having a diameter 55, in some embodiments, the skimmer basket 43 (and in particular the upper opening 51) may be non-circular (e.g., square or rectangular). The rim 53 can be configured to engage with the ledge 41 of the pool skimmer 31 (FIG. 2) to support the skimmer basket 41 within the pool skimmer 31.

Additionally, as illustrated, the main body 49 of the skimmer basket 43 (e.g., the sidewalls 57 and or bottom wall 59 can include a plurality of apertures 55 (such as perforations or openings) configured to provide straining functionality for the skimmer basket 43. The size of the apertures 55 can vary depending on the specific embodiment. In some embodiments, the apertures 55 can be replaced with or include a mesh.

Figure 4A:
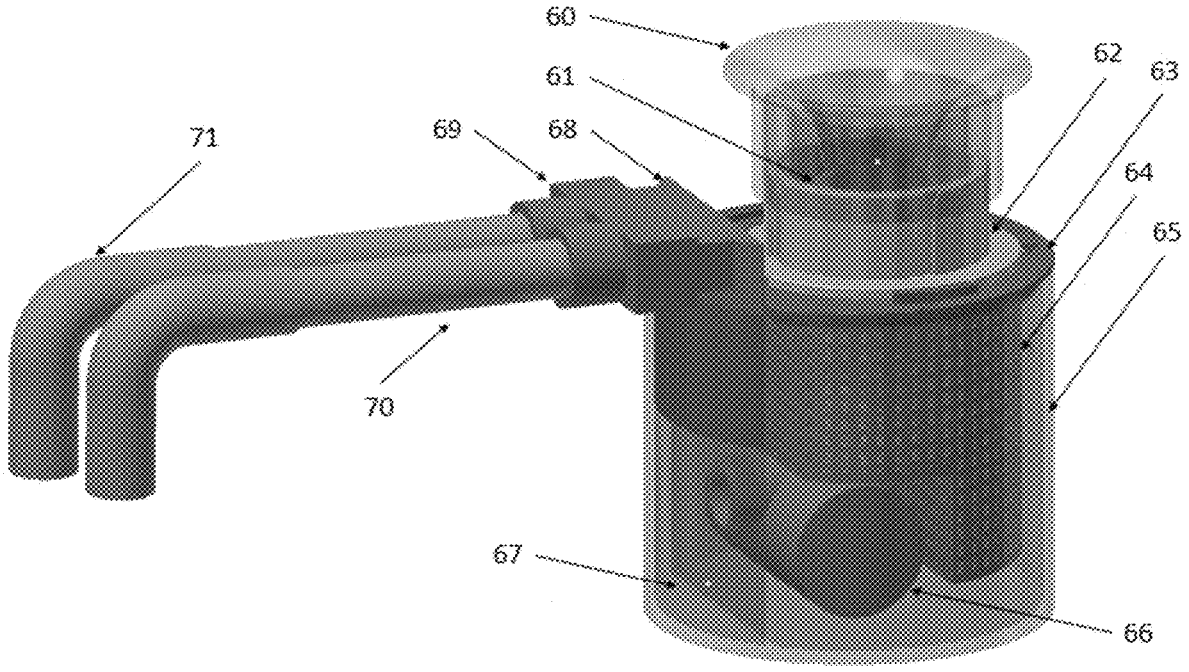
FIG. 4A is a drawing of the powered skimmer device.
Figure 4B:
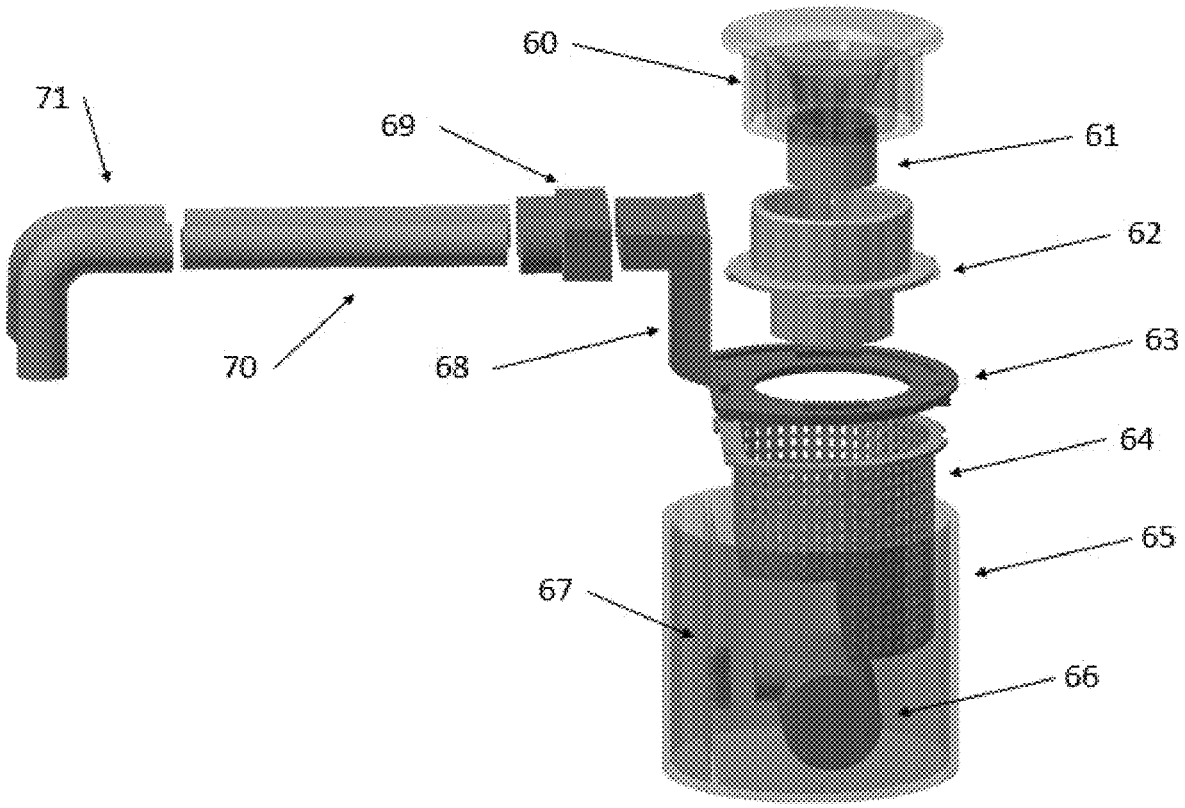
FIG. 4B is an exploded drawing of the powered skimmer device.

FIGS. 4A and 4B illustrate an embodiment of a powered swimming pool skimmer (also referred to as a powered skimmer device) that fits inside a swimming pool's existing skimmer, which pulls surface water from the surface of the pool through the floating, or fixed height, funnel, through the filter basket, with fine or course mesh, through the pump, and back into the pool through the exhaust port and pipes.

The powered skimmer device can be configured to position the larger opening of the funnel at a predetermined depth just below the surface of the water in the pool for manually adjusted funnel depth, or automatically position for floating funnels. When the opening of the funnel is near the surface, the water level in the skimmer device may be lower than the water level in the pool skimmer. This can cause the water to follow the shape of the funnel into the lower part of the funnel and into the basket below. If the skimmer device's opening is deeper than the water in the pool skimmer, the water may swirl and create a strong vortex that may suck debris into the lower part of the funnel and into the basket below.

Floating debris in pool water is trapped within the surface tension of the water. As will become more fully apparent from the following description, when water enters the funnel of the skimmer device, the surface will warp and be pulled into the wide opening, through the narrow opening, and into the attached debris catching skimmer basket. Along with pulling the surface water into the skimmer basket, all or much of the small floating debris, such as pollen, dust, bugs, small leaves, pieces of deteriorating thermo-pool covers, etc., will also be pulled into the skimmer basket.

Almost all of today's swimming pools are filtered by a centralized pump, as shown in FIG. 1. This pump must be very powerful, and its power must be distributed among the skimmers and bottom opens within the pool. The powered skimmer device of FIGS. 4A and 4B can include its own pump that is dedicated to the skimmer in which it is placed. This allows the pump to be very efficient and, in most cases, provide much more suction at lower power ratings, which provides better filtering for lower energy costs.

The interface between the skimmer and the pool water is the funnel 60. In the powered skimmer device of FIGS. 4A and 4B, the funnel is allowed to float, which allows it to adjust to varying water levels in the pool. In some instances, funnel 60 will be fixed, and not floating, this may be advantageous for swimming pools that have a constant water level. Funnel 60 is designed so that water will follow the curve within the funnel. This curve is designed after the shape of a natural water vortex. When the water enters funnel 60, it will fall to the water level within the filter bucket 65. This water level is usually below the top rim of the bucket 65, or three to four inches below the top opening of the funnel 60. Since the water falls into the funnel, any surface debris that is small enough to fit through the funnel, will also fall into the bucket 65. To help aid this fall of surface water, there is a funnel extension 61, that lengthens the bottom opening of the funnel.

Figure 7:
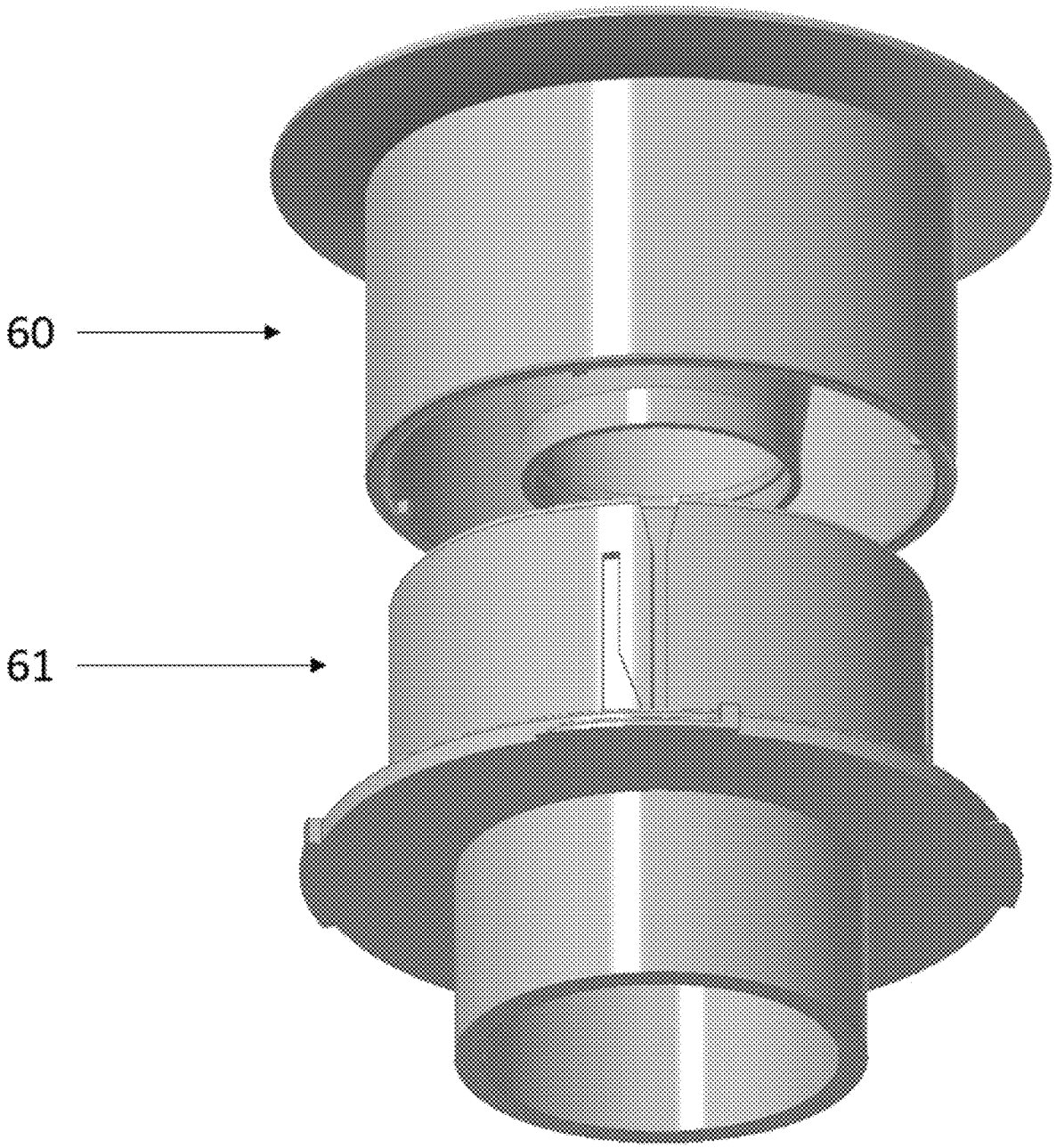
FIG. 7 shows the funnel assembly.

The funnel 60 can attach to the bucket 65 via the funnel plate 62. For the free-floating funnel 60, there can be tracks in the funnel plate 62 for the funnel to freely rise and fall in. However, if properly fitted into the tracks, the funnel 60 cannot be lifted off the funnel plate 62. Therefore, the funnel 60 can freely vertically move within a specified range that is determined by the length of the rails (FIG. 7). For the fixed funnel 60, the height is set for the funnel and it will stay at that height.

The funnel plate 62 can attach to the basket holder plate 63 via a twisting motion that locks it into place. The basket holder plate 63 can serve three purposes: (1) it can adhere or attach the funnel 60 to the bucket 65, (2) it can attach itself to the bucket 65, and (3) it can provide support for the filter basket 64.

The filter basket 64 can be course or fine mesh or other suitable structures. If course mesh, then it will filter out larger debris from the pool. If fine mesh, then it will filter out small debris from the surface water of the pool, such as pollen, ants, bugs, wasps, seeds, saw dust, and any other small particles that may land and float on the surface water of a swimming pool.

In the illustrated embodiment, the pump 66 is located beneath the filter basket in the bucket 65. As it pumps water out of the bucket, surface water will be pulled through the funnel 60 and down through the filter basket 64. Currently, we are using a 1100 GPH bilge pump that provides great water flow. Water flow that is much greater than the average water following through a normal swimming pool skimmer (e.g., as shown in FIG. 1 and FIG. 3). Since the powered skimmer device can use a standard bilge pump, the pump can be easy to replace and available through most distributors.

The pump 66 sucks water through the funnel 60, and it exhausts the filtered water into exhaust port 67. At the exhaust port 67, there can be an exhaust manifold 68, that ports the water away from the powered skimmer device and into the skimmer opening, and then out into the swimming pool. The height of the exhaust manifold 68 is adjustable, and the opening should be level with the bottom of the skimmer opening, which will usually place it under the surface of the water. Since the pump 66 is pumping water out an opening that is lower than the surface of the water, the pump 66 will require much less energy than typical above water pumps. The following parts can help aid the flow of exhaust water into the swimming pool: adapter 69, pipes 70, and directional fittings 71.

The depth of funnel 60 can be determined by the buoyancy of the funnel, the size of the openings, and the velocity of the water through the funnel. In view of these parameters, the opening diameters of the funnel may vary from model to model to suit particular circumstances. Even the length of the funnel extension 61 can be a factor. In some powered skimmer models, there may be a pump speed control that will allow the velocity of the water through the funnel to be adjusted. With this speed adjustment, the depth of the funnel may be adjusted without changing the buoyancy of the funnel 60 of the size of the diameter of the openings.

Figure 5A:
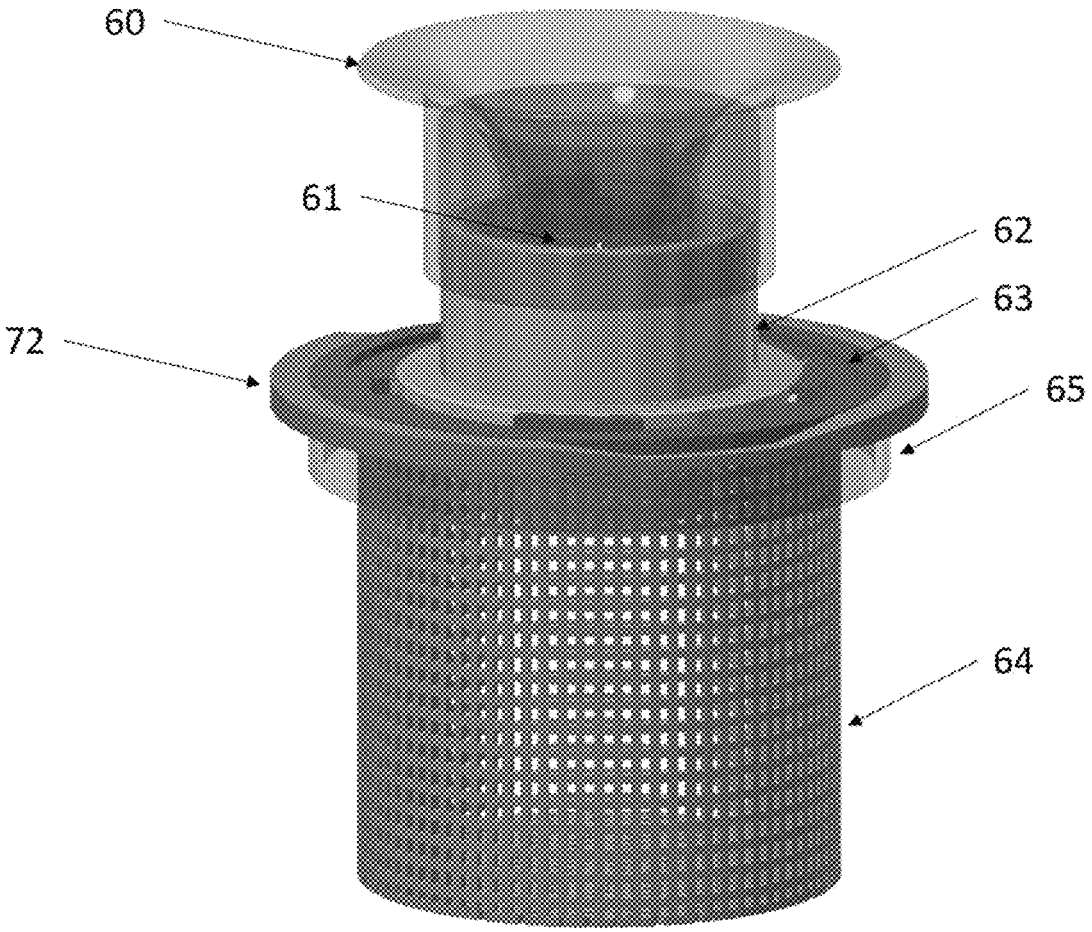
FIG. 5A is a drawing of the non-powered skimmer device.
Figure 5B:
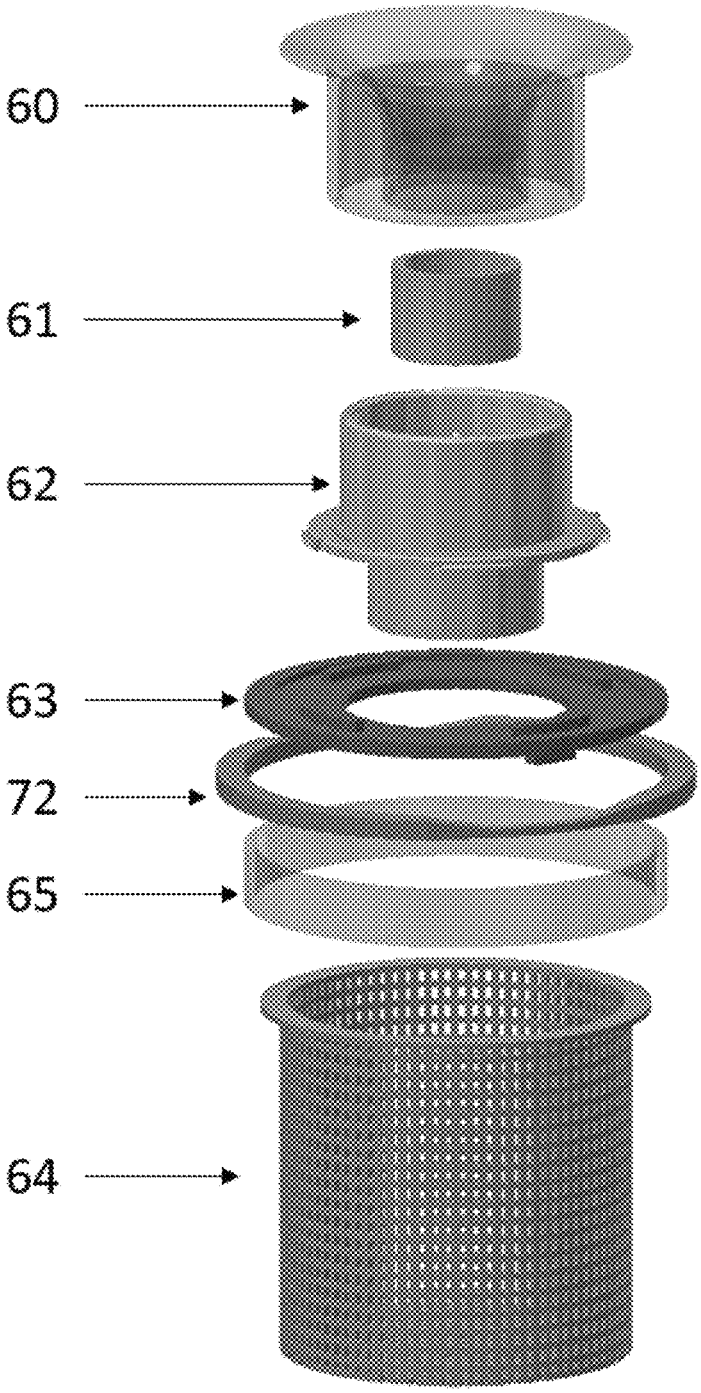
FIG. 5B is an exploded drawing of the non-powered skimmer device.

FIGS. 5A and 5B illustrate an embodiment of a non-powered swimming pool skimmer that fits inside a swimming pools existing skimmer, which pulls surface water from the surface of the pool through the floating, or fixed height, funnel, through the filter basket, with fine or course mesh, and then into the central filter system for the swimming pool.

The non-powered skimmer device in FIGS. 5A and 5B, can function in the same manner as the powered skimmer devices in FIGS. 4A and 4B, except that it may depend on water flow from the swimming pool's central filter system, and is not self-powered.

One advantage that the non-powered skimmer device may have over traditional skimmers (e.g., as shown in FIG. 2) is that water will flow into the funnel 60, and with this flowing water any surface debris will also be pulled down into the skimmer basket. In traditional pool skimmers (FIG. 2) the small floating debris rarely is pulled into the basket.

The interface between the skimmer and the pool water is the funnel 60. In FIGS. 5A and 5B, the funnel is allowed to float, which allows it to adjust to varying water levels in the pool. In some instances, funnel 60 can be be fixed, and not floating, which may be advantageous for swimming pools that have a constant water level. Funnel 60 is designed so that water will follow the curve within the funnel. This curve is designed after the shape of a natural water vortex. When the water enters funnel 60, it will fall to the water level within the filter basket 64. This water level is usually below the top rim of the basket 64, or two to three inches below the top opening of the funnel 60. Since the water falls into the funnel, any surface debris that is small enough to fit through the funnel, will also fall into the basket 64. To help aid this fall of surface water, there is a funnel extension 61, that lengthens the bottom opening of the funnel.

In the illustrated embodiment, the funnel 60 attaches to the bucket via the funnel plate 62. For the free-floating funnel, there can be tracks in the funnel plate 62 for the funnel to freely rise and fall in. However, if properly fitted into the tracks, the funnel cannot be lifted off the funnel plate 62. Therefore, the funnel can freely vertically move within a specified range that is determined by the length of the rails. For the fixed funnel 60, the height is set for the funnel and it will stay at that height.

The funnel plate 62 can attach to the basket holder plate 63 via a twisting motion that locks it into place. The basket holder plate 63 can serve two purposes: (1) it can adhere the funnel 60 to the basket 64, and (2) it can attach itself to the basket 64.

The filter basket 64 can be course or fine mesh or other suitable structure. If course mesh, then it will filter out larger debris from the pool. If fine mesh, then it will filter out small debris from the surface water of the pool, such as pollen, ants, bugs, wasps, seeds, saw dust, and any other small particles that may land and float on the surface water of a swimming pool. It can even be the original equipment manufacturer (OEM) basket that came with the traditional skimmer (FIG. 2 and FIG. 3).

The skimmer adapter ring 72 can seal the non-powered skimmer device so that all suction provided by the swimming pools central pump (FIG. 1) can flow through the non-powered skimmer device. At the bottom on most swimming pool skimmers (FIG. 2) there is either one or two openings. If there is a single opening, then all suction will flow through the non-powered skimmer, and this is the best-case scenario. If there are two holes, then the suction will be shared between the bottom filter opening (see element 29 in FIG. 1) and the non-powered skimmer device. In this case, the non-powered skimmer device will not function as well, unless the central pump's revolutions per minute (RPMs) (see element 21 in FIG. 1) are greatly increased. This defeats the energy efficiency of the non-powered skimmer device, unless the manually adjusted funnel 60 is used. The manually adjusted funnel will increase the surface flow into the skimmer basket, even at lower pump RPM's.

The depth of floating funnel 60 can be determined by the buoyancy of the funnel, the size of the openings, and the velocity of the water through the funnel. It is because of these parameters that the opening diameters of the funnel may vary from model to model. Even the length of the funnel extension 61 is a factor. With the non-powered skimmer device, the pool's central pump defines the velocity of the water through funnel 60, and thus the depth of the funnel below the surface of the water. In single port skimmer (FIG. 2) configurations, the RPM's do not have to be increased by too much, if at all to get the funnel 60 to behave properly. In dual port skimmers (FIG. 2), where one of the ports powers the bottom filters, the RPM's will have to be increased.

Figure 6A:
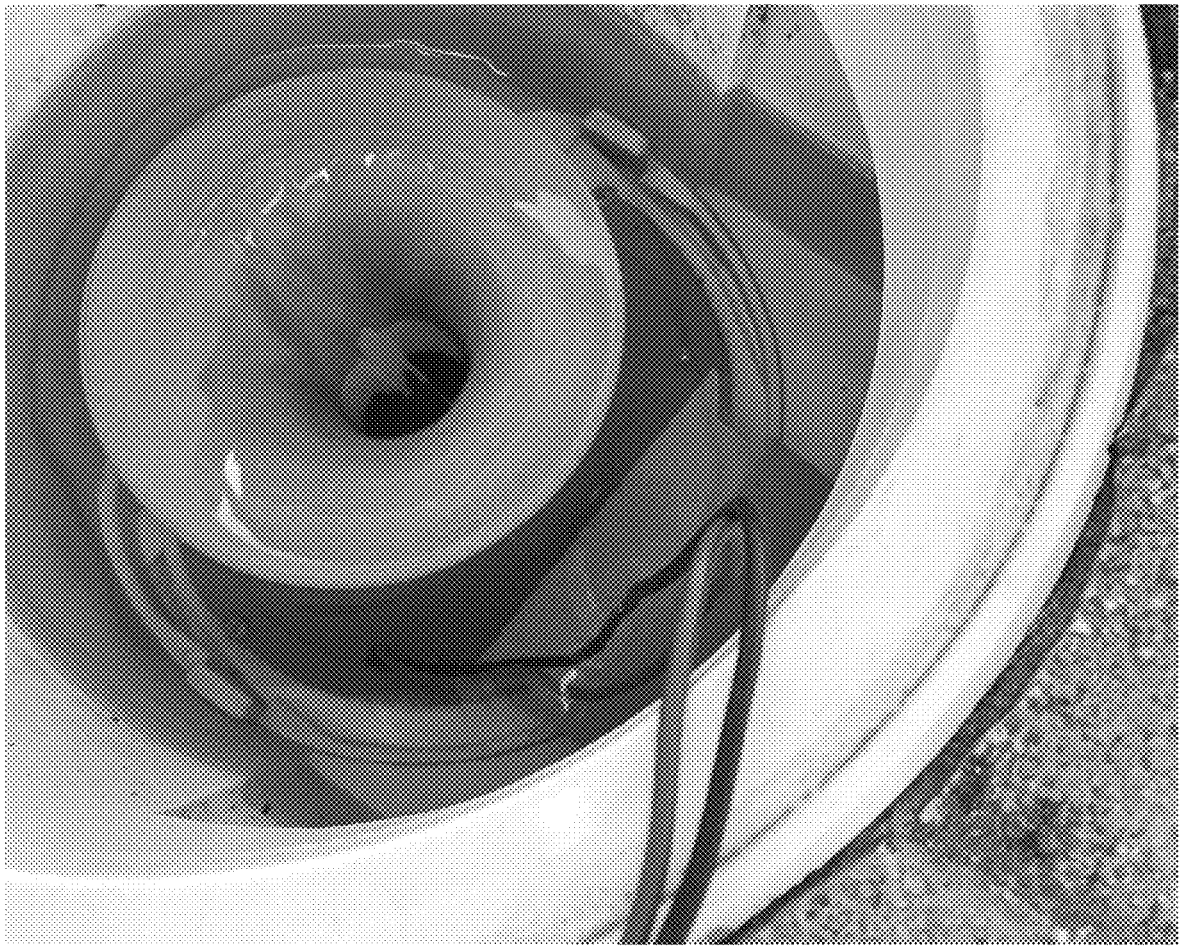
FIG. 6A is a photo of the powered skimmer device in a skimmer.

FIG. 6A shows an embodiment of a prototype powered skimmer device (e.g., as shown in FIGS. 4A and 4B) installed in an existing swimming pool skimmer (such as the skimmer shown in FIG. 2). If observed closely, a person may notice that the funnel is coated with surface water travelling into the skimmer. This prototype has the floating funnel, which keeps the funnel 60 positioned just beneath the surface of the water. In this case, it is about a quarter of an inch below the surface. The pump is pumping 1,100 gallons per hour through the skimmer device. In this test, the skimmer was powered for six days, twenty-four hours per day.

Figure 6B:
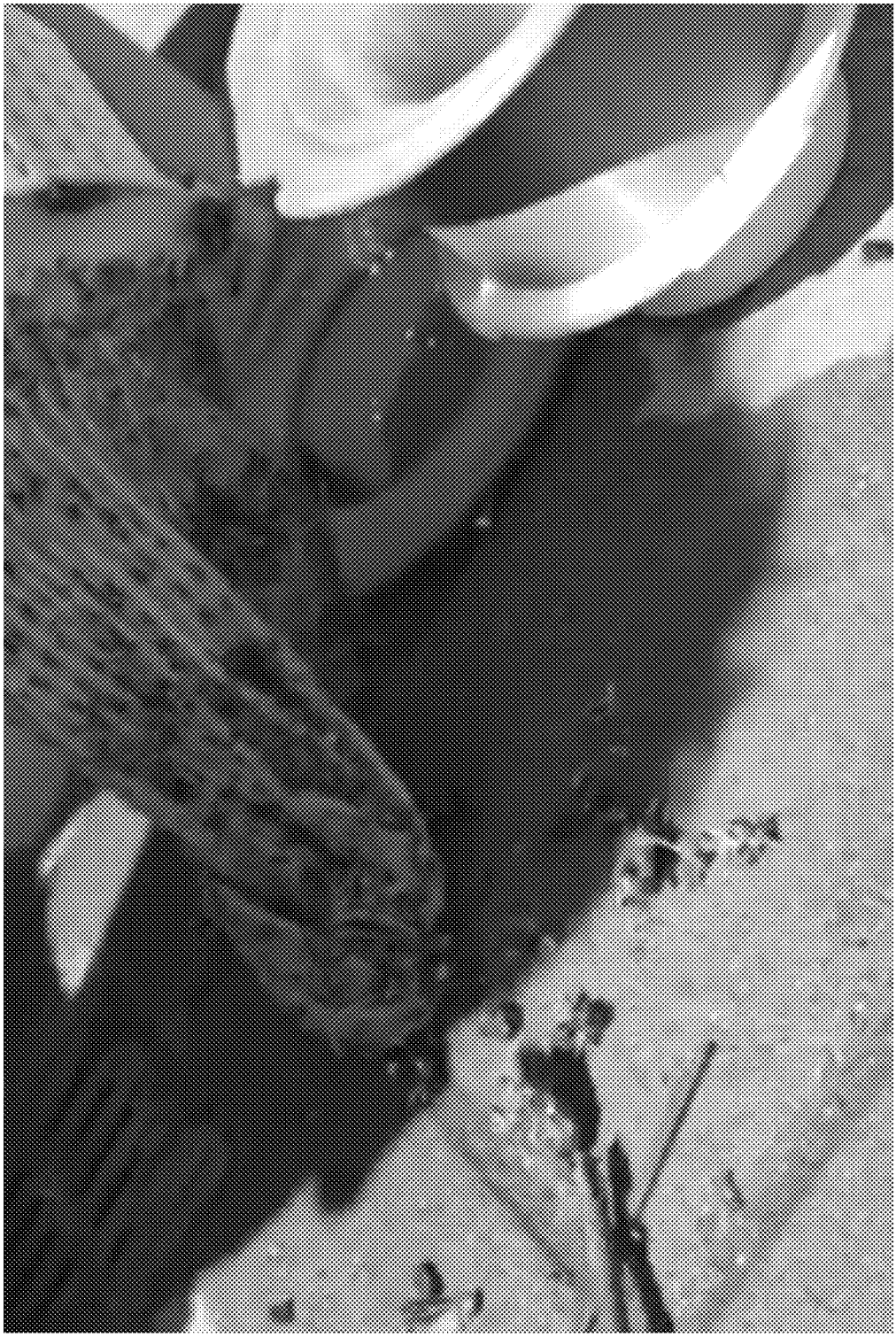
FIG. 6B is a photo of the filter contents after five-day test.

FIG. 6B shows the contents of the filter basket of the powered skimmer device prototype after the test. A person can see that the contents are mostly small debris, such as pollen, dust, bugs, and seeds.

FIG. 7 shows an example funnel assembly that includes tracks a discussed above.

What is claimed is:

1. A powered pool skimmer device, comprising:

a funnel assembly that self-adjusts to a depth to allow swimming pool surface water to enter;

a filter assembly that is positioned below the funnel assembly;

a pump assembly that is positioned below the filter assembly, the pump assembly including a pump configured to draw water through the funnel assembly and filter assembly and exhaust the water through an exhaust;

a main body extending along an axis, wherein the funnel assembly, the filter assembly, and the pump assembly are positioned within the main body and arranged along the axis; and an exhaust port that is contained within the main body and exits out the top of the main body and into the skimmer opening, which will lead out of the skimmer into the body of the pool water.

2. The device of claim 1, wherein the pump assembly is no more than 4 inches below the filter assembly.

3. The device of claim 1, a power wire connected to the pump assembly, wherein the power wire is surrounded by a moldable casing.

4. The device of claim 1, wherein the funnel shape comprises a natural vortex shape at least partially defined by an equation of $-1/x$.

5. The device of claim 1, wherein the filter assembly comprises a filter basket attached to a basket holder plate, which also holds the funnel assembly.

6. The device of claim 1, wherein the powered pool skimmer device is configured to fit inside a pool skimmer without any modification to the pool skimmer.

7. The device of claim 1, wherein a bilge pump is used to power the skimmer.

8. The device of claim 1, wherein filtered exhaust water from the pump is routed through the exhaust port, and back into the swimming pool through the skimmer opening.

9. The device of claim 1, wherein a funnel of the funnel assembly rides in rails or grooves in a funnel plate.

10. The device of claim 1, wherein the powered pool skimmer device is configured to fit into, and seal, a pool skimmer with use of a skimmer adaptor ring.

11. A non-powered pool skimmer device, comprising:

a funnel assembly that self-adjusts to a proper depth to allow swimming pool surface water to enter;

a manually adjustable funnel that can be set to a desired depth under the surface of the water;

a filter assembly that is positioned below the funnel assembly; and an adapter plate that will allow the device to fit different skimmers and skimmer baskets.

12. The device of claim 11, wherein the filter assembly comprises a filter basket attached to a basket holder plate, which also holds the funnel assembly.

13. The device of claim 11, wherein a funnel shape of the funnel is at least partially defined by an equation of $-1/x$.

14. The device of claim 11, wherein the non-powered pool skimmer device is configured to fit inside a pool skimmer without any modification to the pool skimmer.

15. The device of claim 11, wherein a floating funnel of the funnel assembly rides in rails or grooves in a funnel plate.

16. The device of claim 11, wherein the device can fit into, and seal, any skimmer with a skimmer adaptor ring.

* * * * *